US007372019B2

(12) United States Patent
Scheidemann et al.

(10) Patent No.: US 7,372,019 B2
(45) Date of Patent: May 13, 2008

(54) ICP MASS SPECTROMETER

(75) Inventors: Adi A. Scheidemann, Baden (CH); Dirk Ardelt, Krefeld (DE)

(73) Assignee: Spectro Analytical Instruments GmbH & Co. KG (DE)

( * ) Notice: Subject to any disclaimer, the term of this patent is extended or adjusted under 35 U.S.C. 154(b) by 165 days.

(21) Appl. No.: 11/436,993

(22) Filed: May 18, 2006

(65) Prior Publication Data

US 2006/0284076 A1 Dec. 21, 2006

(30) Foreign Application Priority Data

May 18, 2005 (DE) ..... 10 2005 023 590

(51) Int. Cl.
*H01J 49/00* (2006.01)
*H01J 49/10* (2006.01)

(52) U.S. Cl. ..... 250/281; 250/288; 250/286; 250/423 R; 250/396 R; 250/397

(58) Field of Classification Search ..... None
See application file for complete search history.

(56) References Cited

U.S. PATENT DOCUMENTS 5,552,599 A 9/1996 Giessmann et al.
5,801,380 A 9/1998 Sinha
6,107,628 A 8/2000 Smith et al.
6,794,641 B2 * 9/2004 Bateman et al. ..... 250/281
7,095,013 B2 * 8/2006 Bateman et al. ..... 250/281
2004/0211897 A1 10/2004 Kim et al.

FOREIGN PATENT DOCUMENTS

WO WO 03/077281 9/2003

* cited by examiner

*Primary Examiner*—Nikita Wells
(74) *Attorney, Agent, or Firm*—Robert W. Becker; Robert W. Becker & Assoc.

(57) ABSTRACT

An ICP mass spectrometer comprising an ICP ion source, a mass analyzer having a magnetic sector field, a detector, an extraction element in the form of an ion funnel for transferring the generated ions into the mass analyzer and arranged between the ICP ion source and the mass analyzer, and a transport optics arranged between the ion funnel and the mass analyzer.

17 Claims, 3 Drawing Sheets

ICP MASS SPECTROMETER

BACKGROUND OF THE INVENTION

The present invention relates to an ICP mass spectrometer.

Analytical problems in the field of ICP mass spectrometers demand devices which are inexpensive and have high detection limits. In this case small quantities of available test material, on the one hand, and a short measuring time or other reasons, can be behind the demand to supply the highest possible fraction of ions generated by inductively coupled plasma (ICP) to a useable detection.

DE 43 33 469 A1 describes an analytical device comprising an ICP ion source and a connected mass spectrometer of the Nier-Johnson type. In this case only a narrow measuring window can be simultaneously registered, wherein the respectively detected mass can be variably tuned in terms of time. The illustrated spectrometer extracts the ions from the ICP source by means of a separately pumped sampler-skimmer unit.

ICP mass spectrometers are also generally known in which ions from an ICP source can be transferred via a sampler-skimmer unit into a spectrometer of the Mattauch-Herzog type.

U.S. Pat. No. 6,107,628 describes a particle optical system under the term "ion funnel", by means of which improved extraction of charged particles is possible from a region of high pressure between 0.1 mbar and 1 bar into a region of relatively low pressure, in particular a high-vacuum region. The ion funnel can either be constructed as a stack of washers with central apertures that decrease from the high-pressure side to the low-pressure side, wherein the washers are loaded with out-of-phase high frequency alternating voltage, or as a pair of coils, through which current flows, with decreasing diameter. The entire disclosure of U.S. Pat. No. 6,107,628 is hereby incorporated for the purpose of defining the term "ion funnel". The term "ion funnel" also includes interim developments of an extraction optical system corresponding to the design of U.S. Pat. No. 6,107,628.

SUMMARY OF THE INVENTION

The object of the invention is to provide an ICP mass spectrometer in which the transmission of an ICP-generated ion cloud through to a mass-selective or q/m-selective detection is improved.

This object is achieved according to the invention by an ICP mass spectrometer comprising an ICP ion source, a mass analyzer having a magnetic sector field, a detector, an extraction element for transferring the ions generated by the ion source into the mass analyzer, wherein the extraction element is an ion funnel and is arranged between the ICP ion source and the mass analyzer, and a transport optics arranged between the ion funnel and the mass analyzer.

By forming the extraction element as an ion funnel, at a given pressure stage between the ICP source and the mass analyzer, a much larger fraction of the generated ions can be introduced into the analyzer or the high-vacuum region that allows a beam-directing particle optical system, than is the case compared with the sampler-skimmer arrangements of the prior art.

In a preferred embodiment a transport optics, which comprises a first electrostatic sector field, is arranged between the ion funnel and the mass analyzer. This allows improved transmission, wherein filtering-out of neutral particles and photons from the particle beam may be easily ensured as a result of the electrostatic sector field.

The transport optics preferably also comprises a second electrostatic sector field. At least the first electrostatic sector field particularly preferably has a slit for discharging undeflected particles, so that photons and neutral particles can be removed from the optical elements via this slit without it being possible for secondary particles to be produced by sputtering or an insulating covering to be produced on electrode walls. For example the neutral particles exiting though the slit of the sector field can be directly guided into a vacuum pump. The first or even second electrostatic sector field can be used for energy focusing. The electrostatic sector field upstream of the magnetic sector field is particularly advantageously combined with the magnetic sector field in this case to form a double-focusing spectrometer. A spectrometer of the Mattauch-Herzog type, which has a linear focusing plane in which the particle beams associated with the different masses or q/m ratios focus, has proven to be particularly advantageous in this case.

In a further preferred embodiment the transport optics comprises a stigmator element by means of which the particle beam can be asymmetrically distorted in order to focus it onto an aperture slot for example. A stigmator element of this type can be constructed in a simple manner as an electrostatic quadrupole. In a preferred embodiment of a spectrometer according to the invention, an einzel lens is arranged upstream of the first sector field. Improved transport through the first sector field and through the entire particle optical system can be achieved hereby.

The magnetic sector field particularly preferably comprises a permanent magnet. An ICP mass spectrometer according to the invention may be particularly inexpensively formed hereby since an electronic control unit for an electromagnet may be dispensed with.

The ICP ion source is preferably substantially at earth potential. This allows simple sample handling and safe operation of the ICP source. Accordingly the particle optical system and the mass analyzer are arranged at the potential of the particle energy, wherein particular advantages owing to the use of a permanent magnet in the magnetic mass analyzer result in a technical simplification. Furthermore, elements of the transport optics, in particular also the magnetic sector field, are preferably surrounded by a Faraday cage. Consequently the space between particle-optical elements is field-free and special measures such as the arrangement of a flight tube inside the magnetic sector field or between particle-optical elements can be dispensed with.

In a particularly preferred embodiment the detector is a space-resolved detector for simultaneously registering a plurality of particle masses. The detector is advantageously a CCD detector at least 5 cm in length, in particular preferably at least approximately 10 cm in length. The aim here is to simultaneously register the largest possible number of particle masses. In the optimal case the entire element region, or a substantial portion of the element region, can in the process be covered, so that tuning of the mass analyzer can be dispensed with. This is particularly advantageous when using a permanent magnet for the magnetic sector field. The mass spectrometer according to the invention can also be called a mass spectrograph owing to simultaneous registration of a large number of masses by a space-resolved detector.

The object of the invention is also achieved for an ICP mass spectrometer comprising an ICP ion source, a mass analyzer having a magnetic sector field, a detector, and an extraction element for transferring the ions generated by the ion source into the mass analyzer, wherein the extraction element is arranged between the ICP ion source and the mass analyzer. The transmission is increased owing to simultaneous registration of a plurality of particle masses by means of a space-resolved detector as a plurality of masses are registered simultaneously. There is a particularly great improvement in transmission if all, or a substantial portion, of the element spectrum can be simultaneously registered. For this purpose the detector is preferably a CCD detector at least 5 cm in length and in particular preferably at least approximately 10 cm in length. In the case of an instrument according to the invention with a detector at least approximately 10 cm (4 inches) in length, simultaneous registration of all elements from lithium to uranium is possible. With the spectrometer of the invention, the extraction element can, in particular, be a conventional sampler-skimmer element, wherein further advantageous features as discussed above, in particular features of the transport optics, may be present.

Further advantages and features of an ICP mass spectrometer according to the invention can be found in the embodiments described hereinafter and in the dependent claims.

BRIEF DESCRIPTION OF THE DRAWINGS

Two preferred embodiments of an ICP mass spectrometer will be described hereinafter and explained in more detail with reference to the accompanying drawings, in which.

DESCRIPTION OF SPECIFIC EMBODIMENTS

Figure 1:
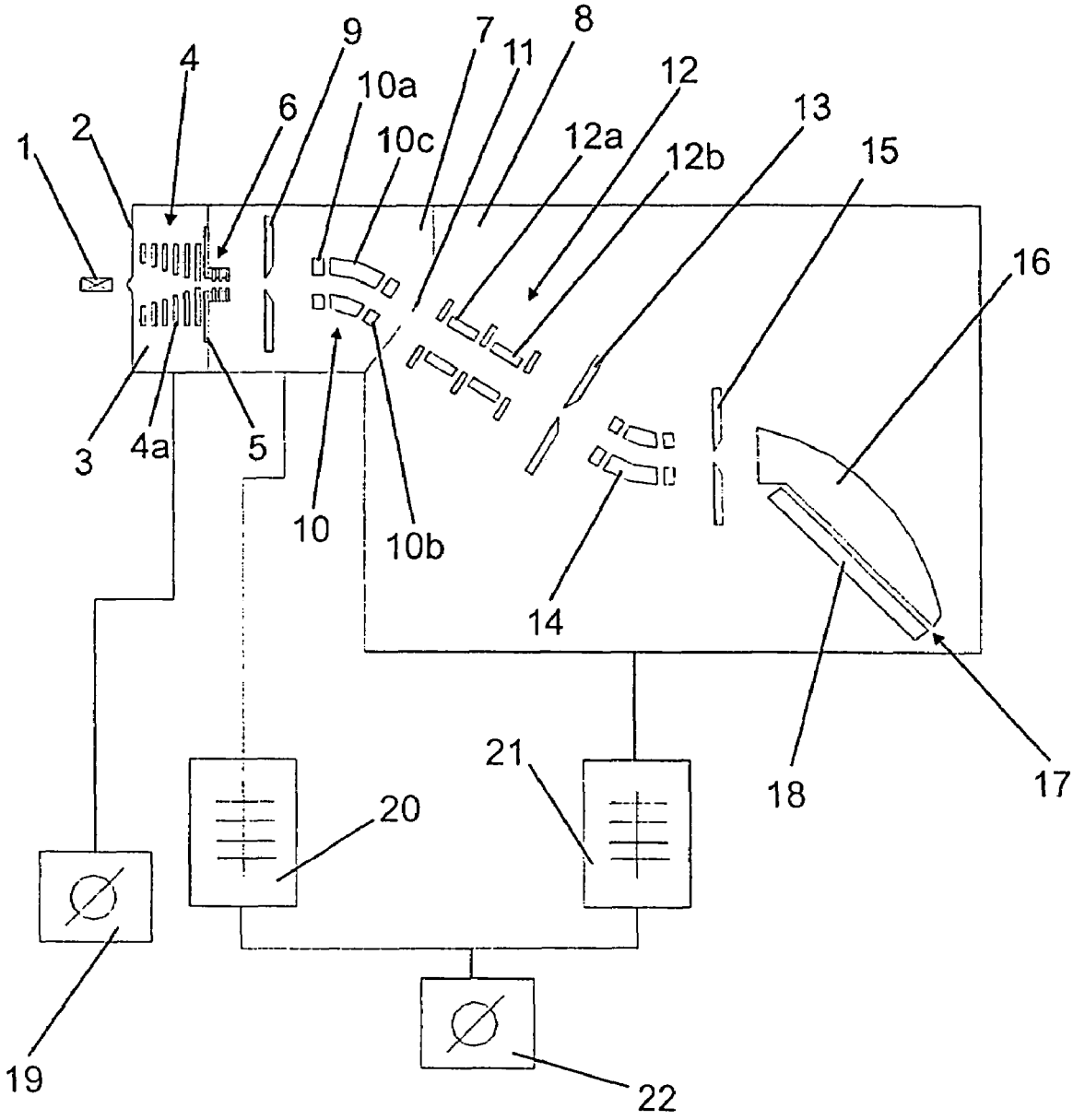
FIG. 1 shows a schematic plan view of a first embodiment of an ICP mass spectrometer according to the invention.

The mass spectrometer according to FIG. 1 comprises an ICP ion source 1, known per se, which via a high-frequency coil {not shown), generates and maintains plasma at a gas pressure of typically 1 bar. The generated ions, but also neutral gas particles and photons, enter, via an aperture in a cone of a partition 2, a space 3 pumped by means of a rotary vane pump 19, in which space an ion funnel 4 is arranged. The partition 2 with the cone corresponds in terms of its shape to a conventional sampler plate. The ion funnel 4 comprises a number of phase diaphragms or aperture plates 4*a*, of which the concentric circular central openings decrease in diameter in the direction of the particle beam. The ion funnel 4 is delimited by a further partition 5 with an aperture 6, as a result of which the pumped space 3 is separated from a first vacuum region 7. The space 3 can preferably be charged with a cooling gas, wherein a constant pressure of the cooling gas may be adjusted as a result of pumping of the space 3. The pressure in the space 3 is typically between 0.1 torr and 10 torr. The cooling gas can, for example, be $H_2$, $D_2$, $NH_3$ or a noble gas, wherein impact-induced fragmentation of ion complexes, reduction of an AR+ current (fuel gas of the ICP source), or targeted charge exchange may be desired. The composition of the particle beam, in addition to energy distribution as a result of cooling, is thus improved in the interest of low-interference registration.

The vacuum region 7 adjoins a second vacuum region 8, wherein both the vacuum region 7 and the second vacuum region 8 are each pumped by turbo molecular pumps 20, 21 and a further rotary vane pump 22.

A short quadrupole or multipole lens can be arranged so as to immediately follow the ion funnel in order to further improve transport of the particles (see U.S. Pat. No. 6,107,628). A first object slit 9, which is at the energy potential of the ions (typically approximately 500 v to 5 kv), is located in the first vacuum region 7 in the direction of movement of the ions. A first electrostatic sector field (ESA) 10, which at the input and output sides comprises respective field-terminating diaphragms 10*a*, 10*b*, follows the object slit 9. A field plate 10*c*, located outside with respect to the particle orbit, of the sector field 10 has a central longitudinal slot, so that the photons and the undeflected neutral particles can exit the sector field 10 through the slot of the field plate 10*c* without colliding.

A housing contraction or separation 11, which separates the first vacuum chamber 7 from the second vacuum chamber 8, follows the first sector field 10. The housing contraction 11 does not have any particle-optical significance but allows a better vacuum in the second vacuum chamber 8 as the vacuum of the first vacuum chamber 7 is still loaded by the neutral particle beam. The vacuum in the first chamber is typically below 1 torr, wherein the vacuum of the second chamber 8 is typically a good high vacuum.

A stigmator element 12, which comprises two quadrupoles 12*a*, 12*b* arranged one after the other, follows the housing separation 11. Cylindrical distortion of the beam as well as deflection for optimized guidance of the beam between the individual apertures of the transport optics can take place via the stigmator element 12 by applying a suitable voltage. In addition, distortions which were introduced into the beam via the first ESA 10 can be corrected by the stigmator element 12.

A slit diaphragm or an object slit 13, which is preferably of an adjustable size, approximately from 0.001 cm to 0.1 cm wide with a height of 1 to 3 mm, is formed so as to follow the stigmator element 12. The beam can be focused and formed on the slit 13 by the stigmator element 12.

A second electrostatic sector field 14 is arranged so as to follow the object slit 13. A slit diaphragm 15 of variably adjustable size follows the second electrostatic sector field 14. The slit diaphragm 15 substantially marks the entrance to a magnetic sector field 16 which is formed by plane-parallel plates of a permanent magnet. The magnetic sector field can also have field-terminating plates (not shown).

The second ESA 14 and the magnetic sector field 16 together form a double focusing spectrometer of the Mattauch-Herzog type. Accordingly there is in the region of the magnetic sector field 16 a linear focusing plane 17 on which the foci of the different masses or q/m ratios are located. An elongated space-resolved detector 18 is arranged in this plane 17. The detector 18 is of the "solid state detector array" type which can, for example, be a CCD sensor. A scintillator and/or a multi-channel plate (MCP) can be arranged upstream of the CCD sensor or it has metal tongues associated with the respective individual pixels for signal amplification.

Figure 2:
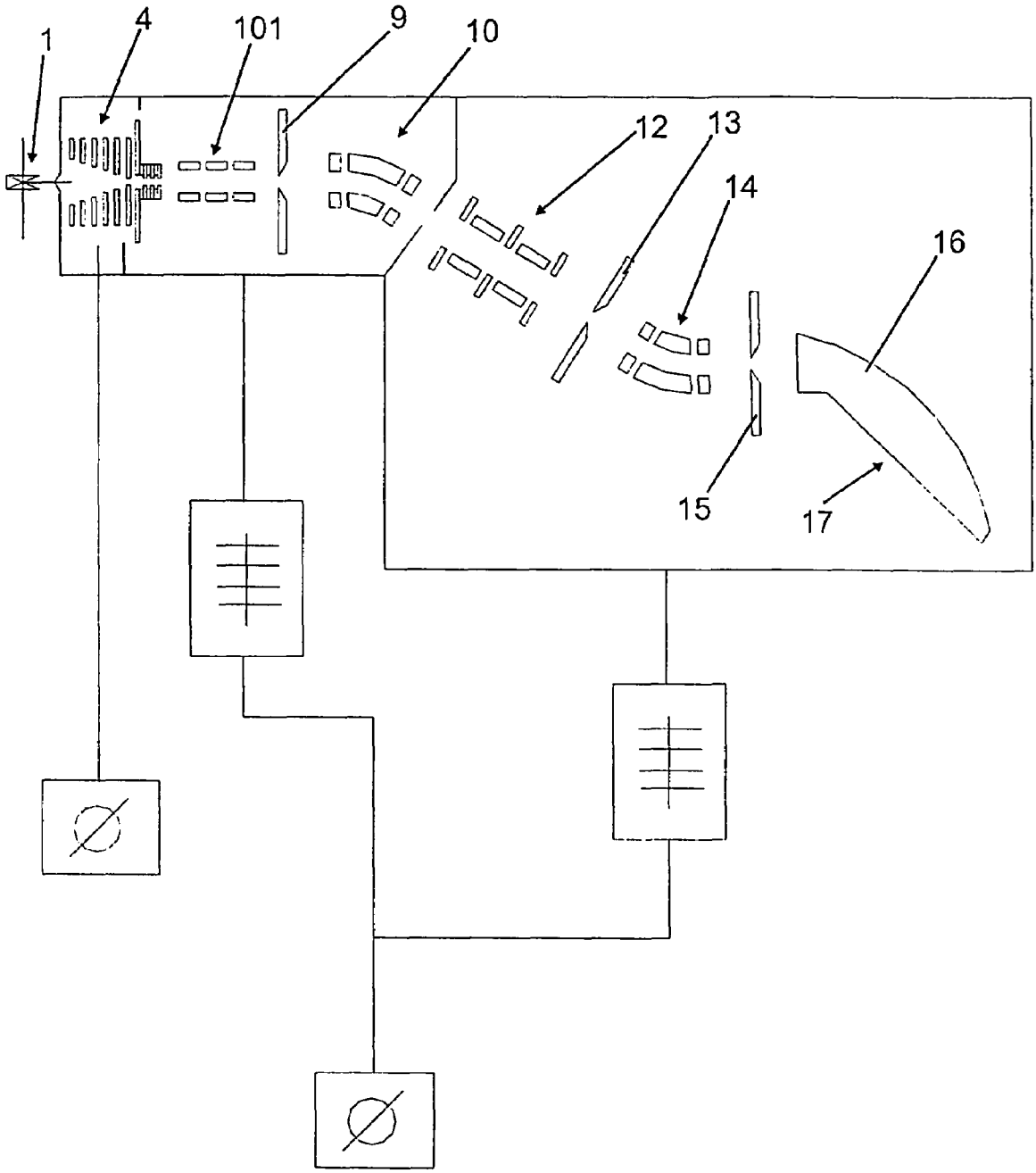
FIG. 2 shows a schematic plan view of a second embodiment of a mass spectrometer according to the invention.

The second embodiment according to FIG. 2, in contrast to the first embodiment, has an additional einzel lens 101 between the ion funnel 4 and the first aperture 9. Focusing of the particle beam and improved transmission through the transport optics is achieved as a result of the einzel lens 101 which is located early in the transport optics.

Figure 3:
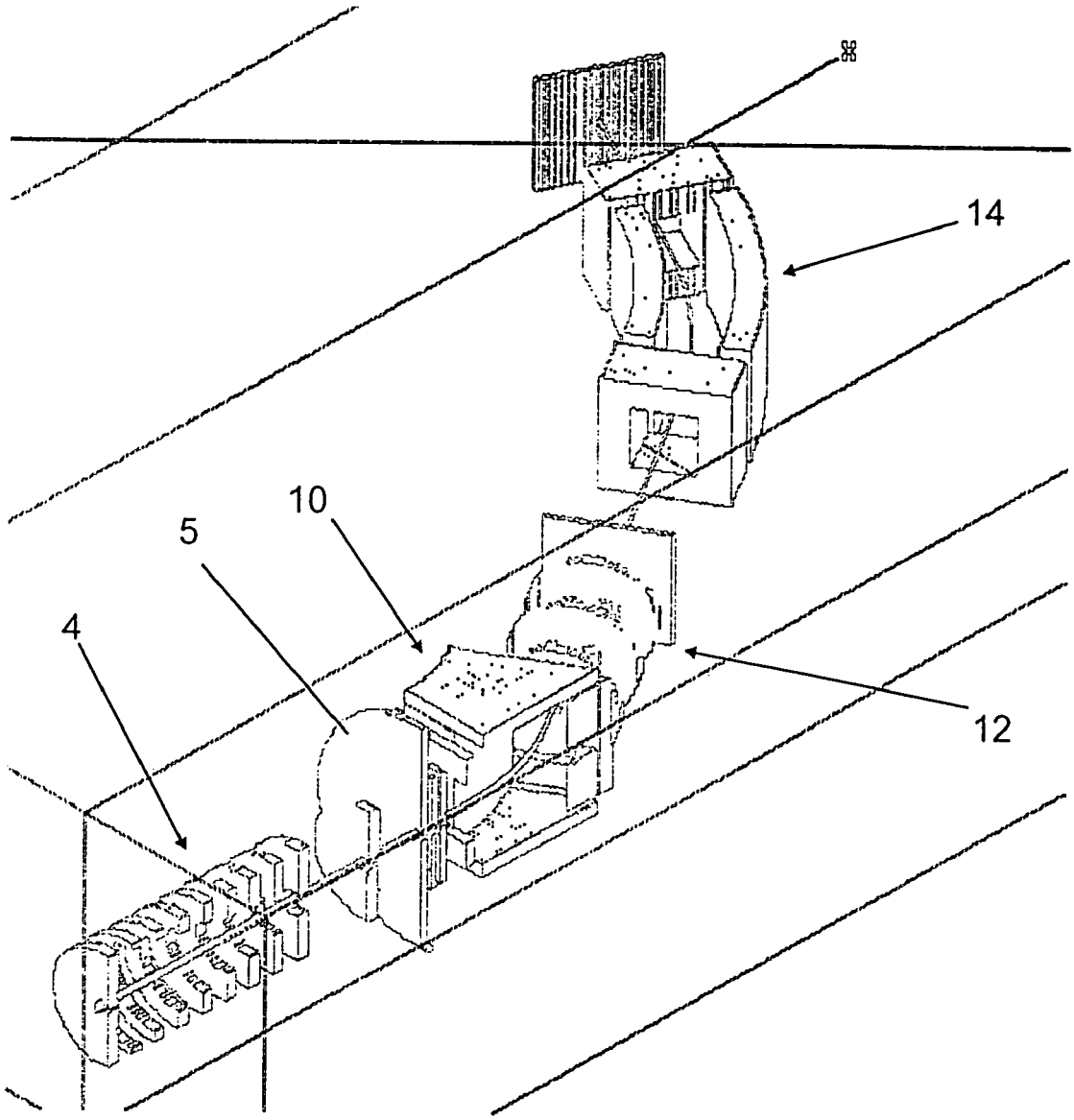
FIG. 3 shows a three-dimensional partial view of a third embodiment of a mass spectrometer according to the invention.

In the third embodiment according to FIG. 3 the difference from the first embodiment according to FIG. 1 lies substantially in the fact that the first sector field 10 has a different direction of curvature than in the first embodiment. While in the first embodiment the sector fields 10, 14 are curved in opposing directions, so that the transport optics has a substantially s-shaped characteristic, the curvatures in the third embodiment are oriented in the same direction in each case. The illustration according to FIG. 3 is a plot from a simulation program for particle optical systems wherein the electrodes of the particle optical system generate a simulated field characteristic according to the method of finite elements. The second electrostatic sector field 14 has a mean deflection angle of $\pi/(4\sqrt{2})$, and this corresponds to the Mattauch-Herzog arrangement.

In all three embodiments the values of the deflection angle of the first ESA 10 and the second ESA 14 30 are substantially the same. In particular the first ESA 10 can, however, also have a different deflection angle, for example 90° or 127°. The first ESA 10 can be used for energy pre-filtering or can function as a simple deflection means for the particle beam.

In all of the embodiments the magnetic sector field 16 and at least the second ESA 14, but preferably also further particle-optical elements (for example detector 18, apertures 13, 15) are arranged on an optical bank and are precisely aligned thereon. The optical bank is fastened so as to be electrically insulated from the vacuum housing and is floated on particle energy. The elements arranged on the optical bank are surrounded by a Faraday cage, so a flight tube is dispensed with, at least in the region of the double-focusing spectrometer.

The particle detector is either fastened to the magnet 16 or the optical bank. The detector supply floats on particle energy. The read-out system of the detector array and the electronic supply device connected thereto (both floated) communicate with the data processing unit via digital lines, and this can be achieved in a simple manner by optical couplers. The supply voltages of the floated electronic device can be provided via DC:DC converters. Fiber-optic solutions are also conceivable.

If the detector is at a different potential to the magnet, it should be electrically insulated. A grating or a similar means for potential separation can be used for this purpose. In such a case the voltage between magnet 16 and detector 18 can be adjusted to a value via which sputtering on the detector and secondary electron generation is kept to a minimum. Such a potential difference can in particular be less than 500 v.

The specification incorporates by reference the disclosure of German priority document 10 2005 023 590.5 filed May 18, 2005.

The present invention is, of course, in no way restricted to the specific disclosure of the specification and drawings, but also encompasses any modifications within the scope of the appended claims.

We claim:

1. An ICP mass spectrometer, comprising:

an ICP ion source;

a mass analyzer having a magnetic sector field;

a detector;

an extraction element for transferring the ions generated by said ion source into said mass analyzer, wherein said extraction element is an ion funnel and is arranged between said ICP ion source and said mass analyzer; and a transport optics arranged between said ion funnel and said mass analyzer.

2. An ICP mass spectrometer according to claim 1, wherein said transport optics comprises a first electrostatic sector field.

3. An ICP mass spectrometer according to claim 2, wherein said transport optics comprises a second electrostatic sector field.

4. An ICP mass spectrometer according to claim 3, wherein at least said first electrostatic sector field comprises a slotted field plate for discharging non-transported particles.

5. An ICP mass spectrometer according to claim 2, wherein said transport optics comprises a stigmator element.

6. An ICP mass spectrometer according to claim 2, wherein a lens is arranged upstream of said first electrostatic sector field.

7. An ICP mass spectrometer according to claim 1, wherein said magnetic sector field comprises a permanent magnet.

8. An ICP mass spectrometer according to claim 1, wherein said ICP ion source is substantially at earth potential.

9. An ICP mass spectrometer according to claim 8, wherein elements of said transport optics are surrounded by a Faraday cage.

10. An ICP mass spectrometer according to claim 9, wherein said magnetic sector field is also surrounded by a Faraday cage.

11. An ICP mass spectrometer according to claim 1, wherein said detector is a space-resolved detector for simultaneous registration of a plurality of particle masses.

12. An ICP mass spectrometer according to claim 11, wherein said detector is a CCD detector of at least 5 cm length.

13. An ICP mass spectrometer according to claim 12, wherein the length of said detector is at least approximately 10 cm.

14. An ICP mass spectrometer according to claim 1, wherein said magnetic sector field does not comprise a flight tube.

15. An ICP mass spectrometer, comprising:

an ICP ion source;

a mass analyzer having a magnetic sector field;

a detector, wherein said detector is a space-resolved detector for simultaneous registration of a plurality of particle masses; and an extraction element for transferring the ions generated by said ion source into said mass analyzer, wherein said extraction element is an ion funnel and is arranged between said ICP ion source and said mass analyzer.

16. An ICP mass spectrometer according to claim 15, wherein said detector is a CCD detector of at least 5 cm length.

17. An ICP mass spectrometer according to claim 16, wherein said detector has a length of at least approximately 10 cm.

* * * * *